US005094176A

United States Patent [19]

Thompson

[11] Patent Number: 5,094,176

[45] Date of Patent: Mar. 10, 1992

[54] DISPLAY AND PRESENTATION TABLE

[76] Inventor: Cynthia S. Thompson, P.O. Box 10318, Portland, Me. 04104

[21] Appl. No.: 611,327

[22] Filed: Nov. 13, 1990

Related U.S. Application Data

[63] Continuation of Ser. No. 364,882, Jun. 12. 1989, abandoned.

[51] Int. Cl.[5] ..... A47B 3/06

[52] U.S. Cl. ..... 108/157; 248/166

[58] Field of Search ..... 108/157, 150, 111; 280/188.6, 167, 166, 165

[56] References Cited

U.S. PATENT DOCUMENTS

| | | | |
|---|---|---|---|
| 136,056 | 2/1873 | Groves | 108/157 |
| 1,251,661 | 1/1918 | Hendershott | 108/157 |
| 1,833,178 | 11/1931 | Rice | 108/157 |
| 1,904,795 | 4/1933 | McFarland | 108/157 |
| 1,940,117 | 12/1933 | Carpos | 108/157 |
| 1,979,843 | 11/1934 | Roos | 248/167 X |
| 2,617,474 | 11/1952 | Keely | 248/167 |
| 3,563,538 | 2/1971 | Harper | 248/166 X |
| 4,138,951 | 2/1979 | Nelson | 108/157 X |
| 4,825,781 | 5/1989 | Palmer | 108/150 X |

FOREIGN PATENT DOCUMENTS

| | | | |
|---|---|---|---|
| 1024318 | 3/1953 | France | 108/157 |
| 652211 | 4/1951 | United Kingdom | 108/157 |

*Primary Examiner*—José V. Chen

*Attorney, Agent, or Firm*—Iandiorio & Dingman

[57] ABSTRACT

A display table including a plurality of substantially rigid vertical support members, each having upper and lower ends, the support members being interconnected to hold them in substantially vertical positions. There is a horizontal top member and connecting members for provisionally connecting the top member to the vertical support members at their upper ends. There is in addition a tensioning membrane and attachment members for provisionally attaching the tensioning membrane to the top member and the lower end of at least one of the vertical support members to rigidify the top and vertical members.

16 Claims, 10 Drawing Sheets

DISPLAY AND PRESENTATION TABLE

This is a continuation of application Ser. No. 07/364,882, filed June 12, 1989 now abandoned.

FIELD OF INVENTION

This invention relates to a display and presentation table and more particularly to a portable table which utilizes tensioned stretch fabric as an integral part of the rigidifying structure.

BACKGROUND OF INVENTION

Conventional display tables, especially those used at conventions and trade shows, are typically either heavy, bulky, and difficult to assemble or lightweight and lacking strength. In addition, these conventional display tables are not truly collapsible because they use removable hardware to hold the table pieces together. When disassembled, these tables consist of many pieces, making packing and shipping difficult.

Even though eye appeal is an important factor in display, conventional display tables are typically simply painted or have a fabric skirt to hide the table structure. As a result, these tables are often drab or boxy looking. In addition, the color of the tables cannot be easily changed to enhance the object being displayed. This results in a less appealing product presentation and may lead to decreased interest in the product by trade show attendees.

SUMMARY OF INVENTION

It is therefore an object of this invention to provide a display table which is lightweight and strong.

It is a further object of this invention to provide a display table which is easy to assemble and disassemble.

It is a further object of this invention to provide a display table which is assembled and disassembled without tools.

It is a further object of this invention to provide a display table which has few parts when disassembled by collapsing for ease of packing and shipping.

It is a further object of this invention to provide a display table which has a curvilinear, soft, sculptured look when assembled.

It is a further object of this invention to provide a display table which is colorful and in which the color can be easily changed.

This invention results from the realization that portable display tables can be improved considerably by constructing them of strong, lightweight materials which are hingedly and/or provisionally connected to provide ease in assembly and disassembly and securing them with a membrane of stretch fabric which provides structural tension and beauty.

This invention features a display table which includes a plurality of substantially rigid vertical support members each having upper and lower ends and means for interconnecting these vertical support members to hold them in substantially vertical positions. There is a horizontal top member and means for provisionally connecting this top member to the vertical support members at their upper ends. There are tensioning membrane means and means for provisionally attaching the tensioning membrane means to the top member and the lower end of at least one of the vertical support members to rigidify the display table.

The display table may further include one or more horizontal shelf members, each one hingedly connected to one of the vertical support members. Further included may be means for provisionally connecting each of the shelf members to one or more of the vertical support members. This means for provisionally connecting may include one or more engagement members fastened to the vertical support members and complementary engagement members fastened to the shelf members positioned to engage and lock with each other.

The means for provisionally connecting the top member to the vertical support members may include a plurality of engagement members fastened to the top member and complementary engagement members fastened to the vertical support members positioned to engage and lock with each other. In addition, the means for provisionally attaching the tensioning membrane means to the top member may include a plurality of engagement members fastened to the tensioning membrane means and complementary engagement members fastened to the top member positioned to engage and lock with each other. The means for provisionally attaching the tensioning membrane means to the lower end of at least one of the vertical support members may include a seam disposed in the tensioning membrane means to wrap around and grip the lower ends of the vertical support members. The means for provisionally connecting the tensioning membrane means to the top member may include a seam disposed in the tensioning membrane means to wrap around and grip the top member.

The top member may include two substantially identical top member pieces hingedly connected at adjacent ends. In a preferred embodiment, the top member may be circular, semi-circular, or semi-annular. Each of these top members may further include two substantially identical top member pieces hingedly connected at adjacent ends. The vertical members may be held in a closed shape, which, is preferably a trapezohedron. The vertical members may be trapezoidal.

In an alternative preferred embodiment, the means for interconnecting the vertical support members may include hinge means. The hinge means may include a compressed area of the vertical members which acts as a hinge. In addition, the tensioning membrane means may include stretch fabric means. In a preferred embodiment, the stretch fabric means may be provisionally connected to the lower ends of each of the vertical support members. The vertical members may be formed from a single member with at least one compressed hinge area.

DISCLOSURE OF PREFERRED EMBODIMENT

Other objects, features and advantages will occur from the following description of a preferred embodiment and the accompanying drawings, in which.

A display table according to this invention may be accomplished by including a plurality of vertical support members hingedly interconnected to hold the members in generally vertical positions and allow the table to be fully collapsed. The table may include one or more shelf members, each shelf member hingedly and/or provisionally connected to one of the vertical support members. Engagement members are fastened to the undersides of the shelf members and at least one of the vertical support members. These engagement members allow the shelf members and vertical support members to engage and lock with each other to provide provisional support for the shelf members and added rigidity for the vertical support members. The display table also includes a top member, which may be circular, semi-circular or semi-annular. The top member may include two substantially identical top member pieces hingedly connected at adjacent ends to allow more complete disassembly. Lastly, there are tensioning membrane means, which may be a stretch fabric, and means for provisionally connecting this tensioning membrane means to the top member and the lower end of at least one of the vertical support members. Preferably, this stretch fabric covers the entire top and front of the display table when it is fully assembled. Alternatively, it may cover the entire table.

In certain embodiments, the means for provisionally connecting the stretch fabric to the top member includes engagement members fastened to the stretch fabric and the underside of the top member and positioned to engage and lock with each other. Alternatively, the stretch fabric may h=connected to the top member by providing seams disposed in the fabric to wrap around and grip the top member. The stretch fabric is connected to the vertical support members by providing seams disposed in the fabric to wrap around and grip the lower ends of the support members.

Figure 1:
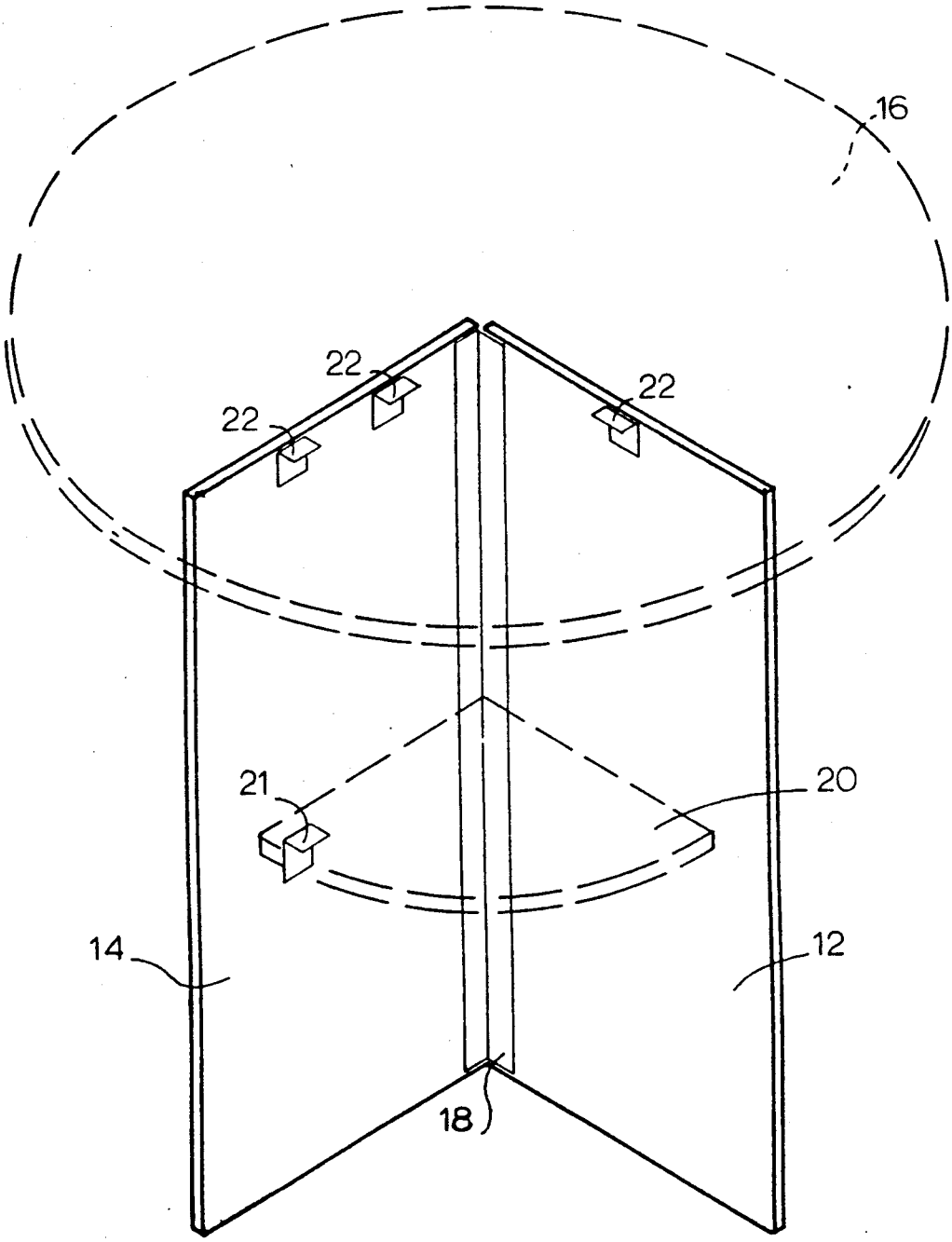
FIG. 1 is an axonometric view of a display table according to this invention.

There is shown in FIG. 1 a partially assembled display table 10 including vertical support members 12 and 14 interconnected by hinge 18. There is a top member 16, shown in dashed line, and a shelf member 20 also shown in dashed line. Engagement members 22 are fastened to the vertical support members and positioned to engage and lock with similar engagement members fastened to top member 16, not shown. These engagement members provide a method for provisionally attaching top member 16 to vertical support members 12 and 14.

Shelf 20 is connected to the face of vertical support member 12 by a hinge, not shown. Engagement member 21 is attached to the underside of shelf member 20 and is positioned to engage and lock with a similar engagement member, not shown, attached to vertical support member 14. These engagement members provide provisional support for shelf member 20 and added rigidity to vertical support members 12 and 14.

Figure 2:
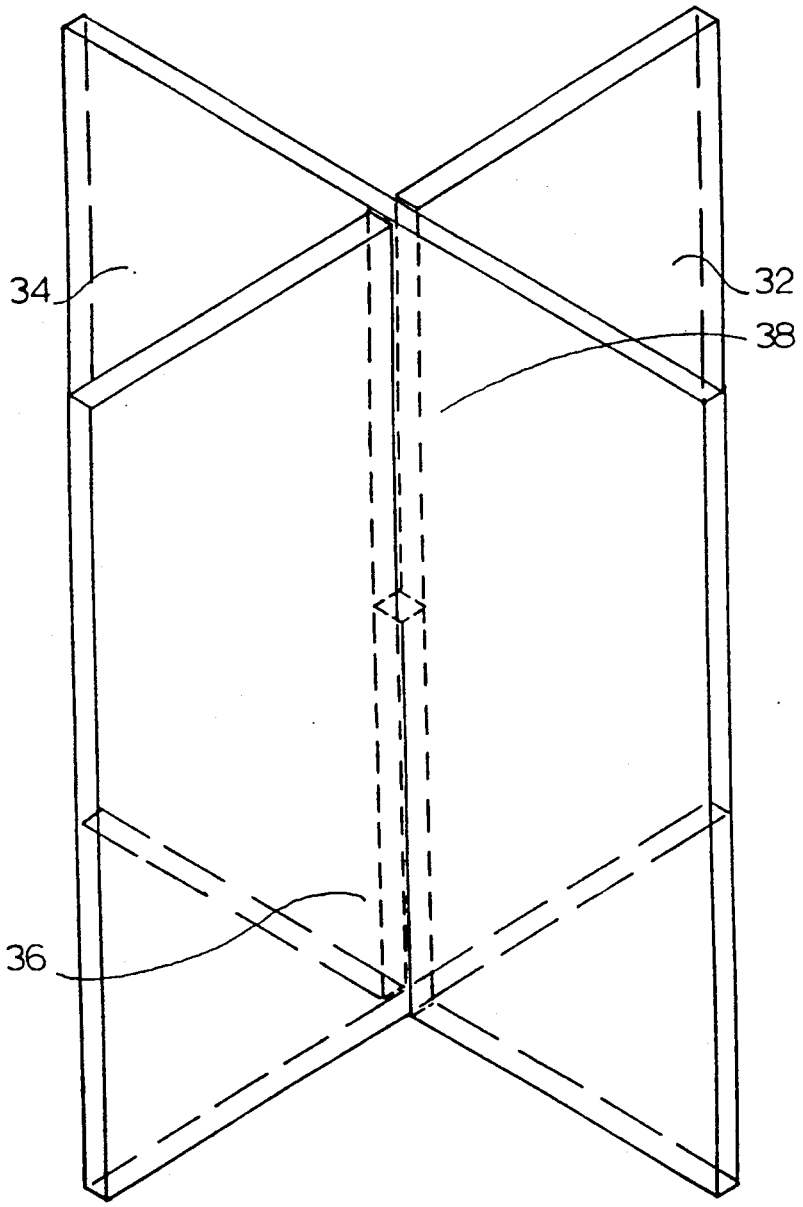
FIG. 2 is an axonometric view of the vertical support members of an alternative display table according to this invention.

An alternative means for interconnecting the vertical support members is disclosed in FIG. 2. These means include slot 38 in vertical support member 32 and complementary slot 36 in vertical support member 34 engaged as shown in FIG. 2.

Figure 3:
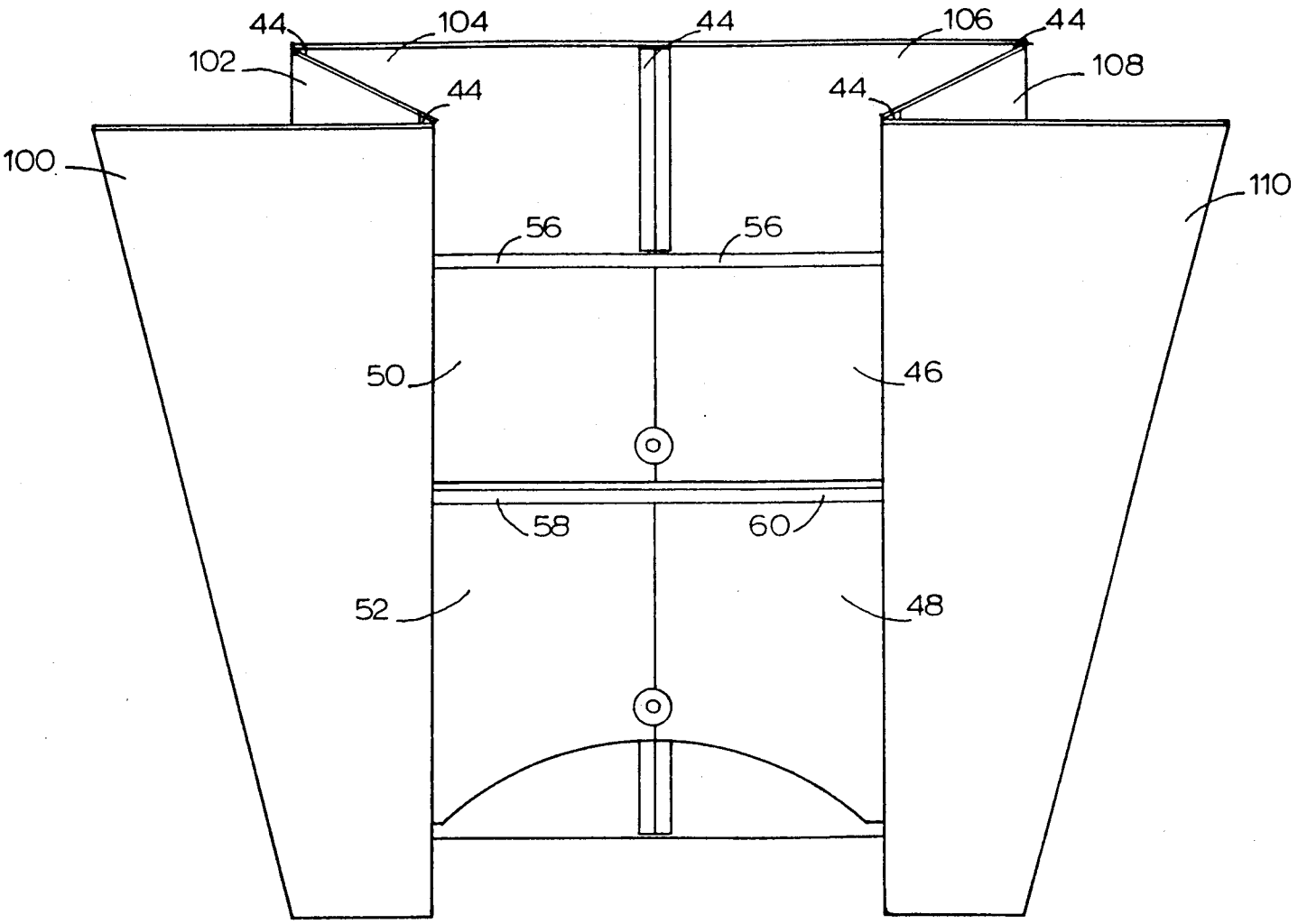
FIG. 3 is an axonometric view of another alternative embodiment of the vertical support members and shelf members of a display table to this invention.

In another embodiment, partially assembled display table 40, FIG. 3, includes six vertical support members 100, 102, 104, 106, 108 and 110. These support members are interconnected by hinges 44. In this embodiment, the table includes four shelf members 46, 48, 50 and 52. Shelf members 46 and 48 are connected to the face of vertical support member 106 by means of hinges 56 and 60, respectively. Shelf members 50 and 52 are connected to the face of vertical support member 104 by means of hinges 54 and 58, respectively. The shelves may include cutouts, as shown in shelves 48 and 52, which allow a person to stand closer to the table top when the display table is fully assembled.

Figure 4A:
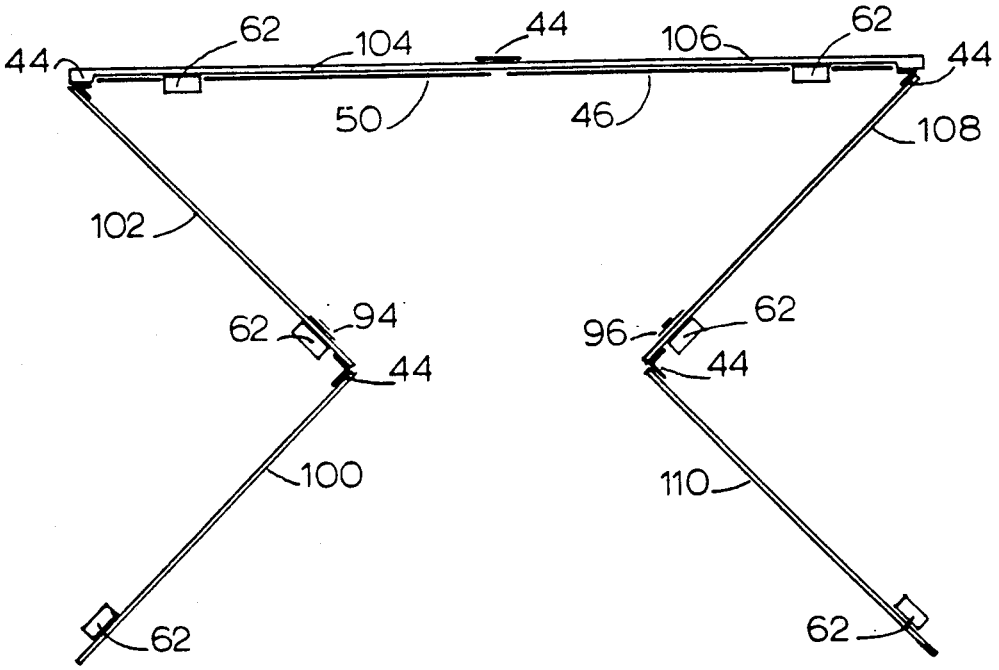
FIG. 4A is a top plan view of the display table of FIG. 3 showing the engagement members and means for interconnecting the vertical support members.

FIG. 4A details the engagement members and hinges of the display table 40 of FIG. 3. The vertical support members are interconnected by hinges 44. This hinge arrangement allows the display table 40 to be fully folded when disassembled within the area of the two back members 104 and 106 for easy UPS shipping. Also included are engagement members 62 attached to vertical support members and positioned to engage and lock with complementary engagement members 66, FIG. 5A, attached to a top member. Engagement members 94 and 96 are positioned to engage and lock with complementary engagement members, 116, FIG. 4B, on shelves 50 and 46.

Figure 4B:
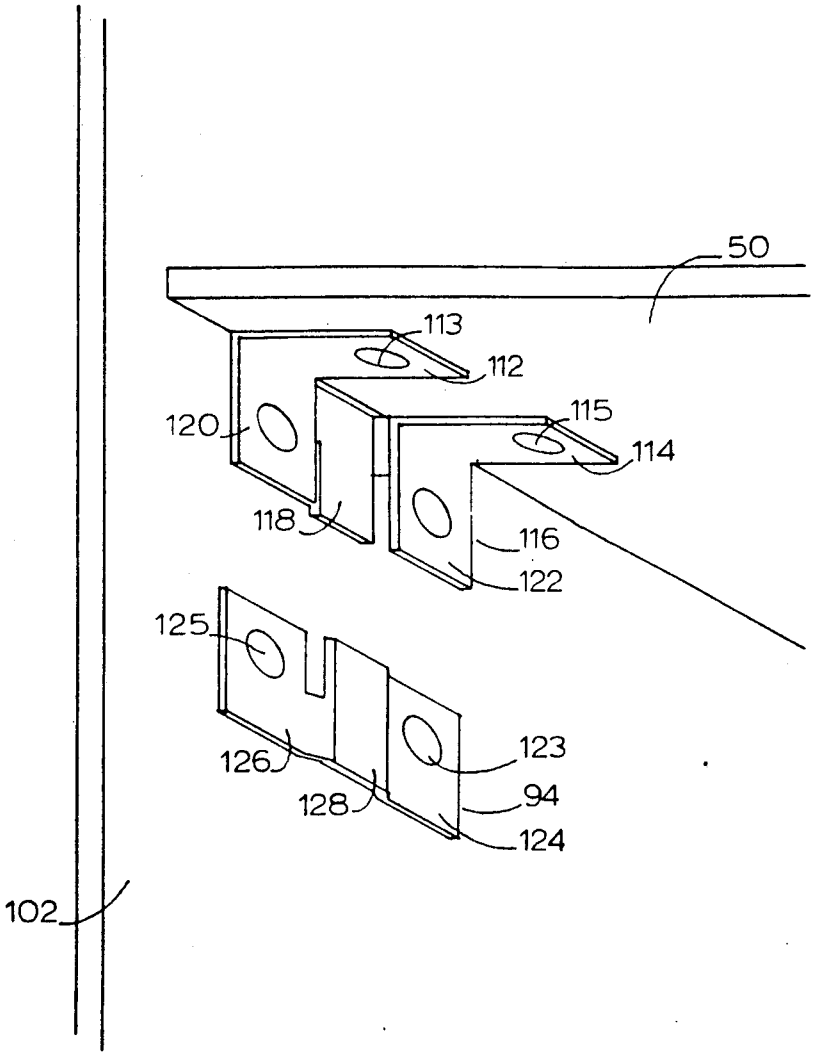
FIG. 4B is an axonometric view of two partially engaged engagement members.

FIG. 4B shows a detailed, enlarged view of partially engaged engagement members 94 and 116. Engagement member 94 is attached to vertical support member 102 by fastening means 123 and 125 of attachment legs 124 and 126 respectively. Engagement member 116 is attached to the underside of shelf member 50 by fastening means 113 and 115 of attachment legs 112 and 114 respectively. Engaging leg 118 of engagement member 116 is positioned to engage and lock with engaging leg 128 of engagement member 94. When engaged, engagement members 94 and 116 provide provisional support for shelf member 50 and added rigidity to vertical support members 102 and 104, FIG. 3.

Figure 5A:
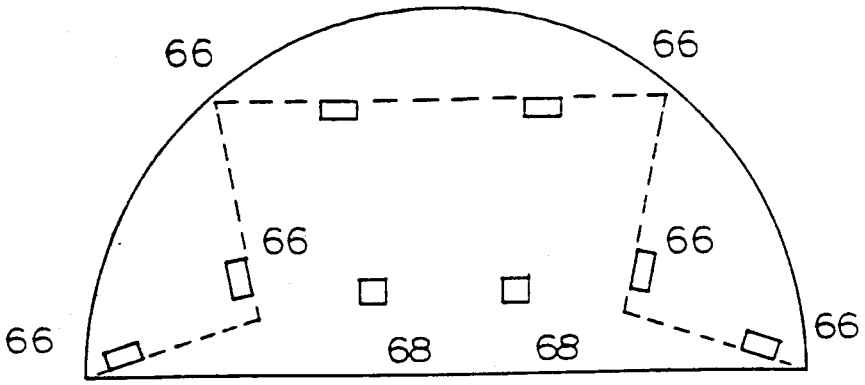
FIG. 5A is a bottom plan view of a top member of a display table according to this invention detailing the engagement members for provisionally connecting the tensioning web means and the vertical support members.
Figure 5B:
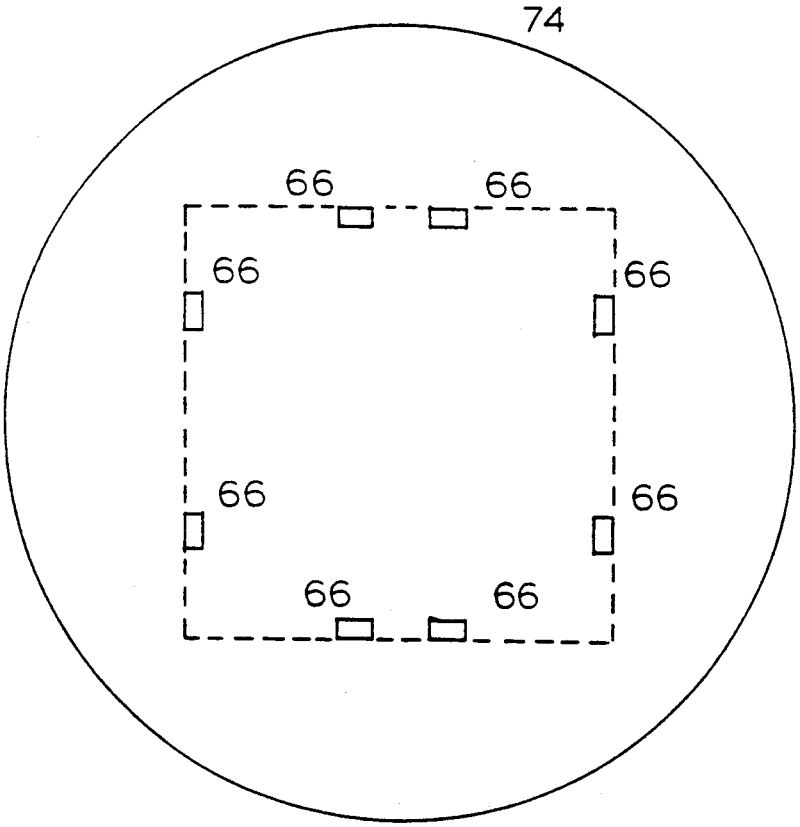
FIG. 5B is a bottom plan view of an alternative embodiment of a top member.
Figure 5C:
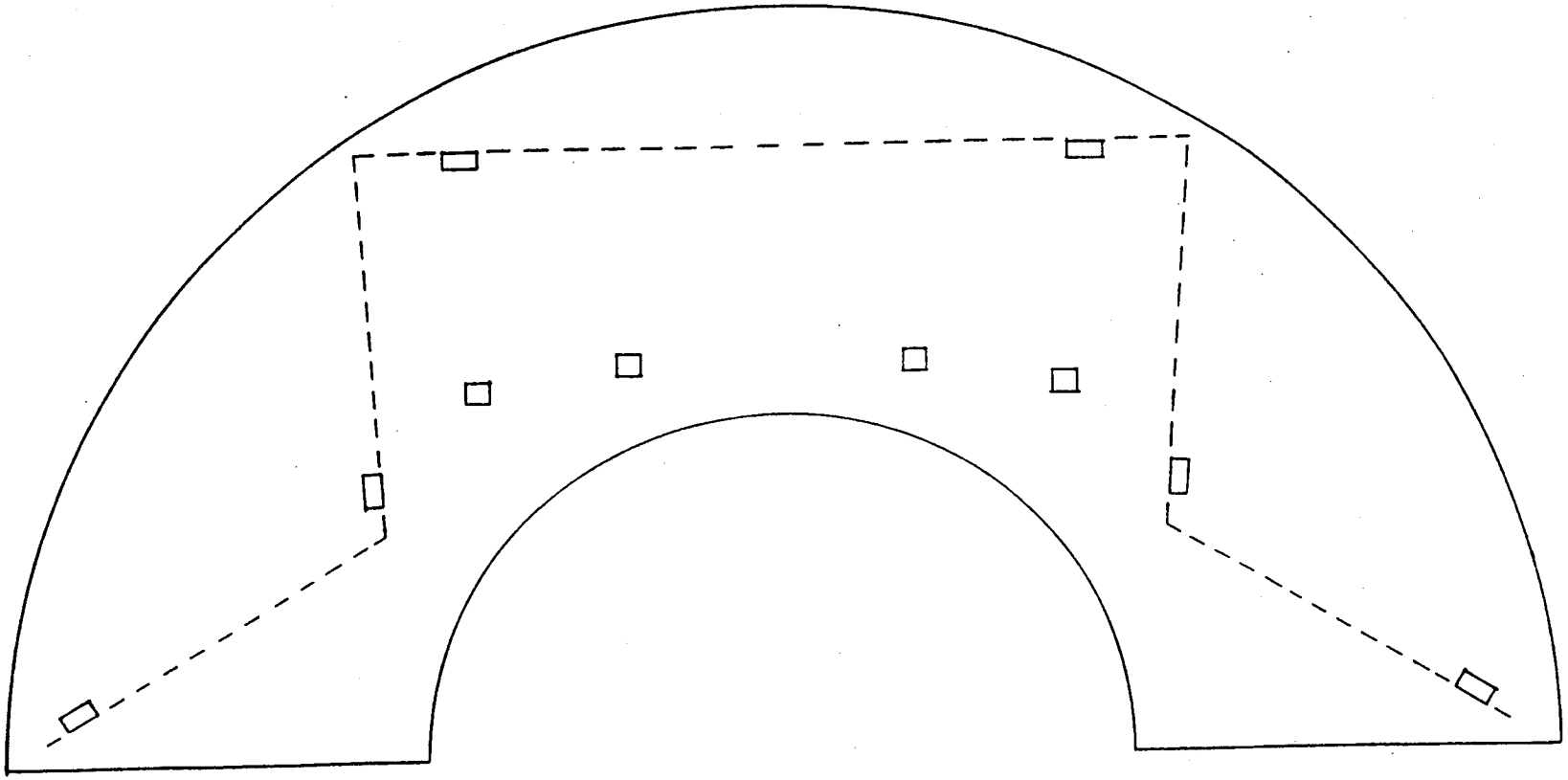
FIG. 5C is a bottom plan view of another alternative embodiment of a top member showing the hinge means connecting the top member pieces.

FIGS. 5A, 5B, and 5C show alternative embodiments of top members for the display table. Semi-circular top member 64, FIG. 5A, includes engagement members 66 attached to the bottom side of top member 64 and positioned to engage and lock with complementary engagement members 62, FIG. 4. Engagement members 68 are included to allow attachment of the stretch fabric means. FIG. 5B discloses an alternative circular top member 70. FIG. 5C discloses another alternative top member 78 which includes two substantially identical top member pieces 72 and 76. Top member pieces 72 and 76 are interconnected at adjacent ends by hinge 74. Hinge 74 allows top member 78 to be folded upon disassembly to provide ease of packing.

Figure 6:
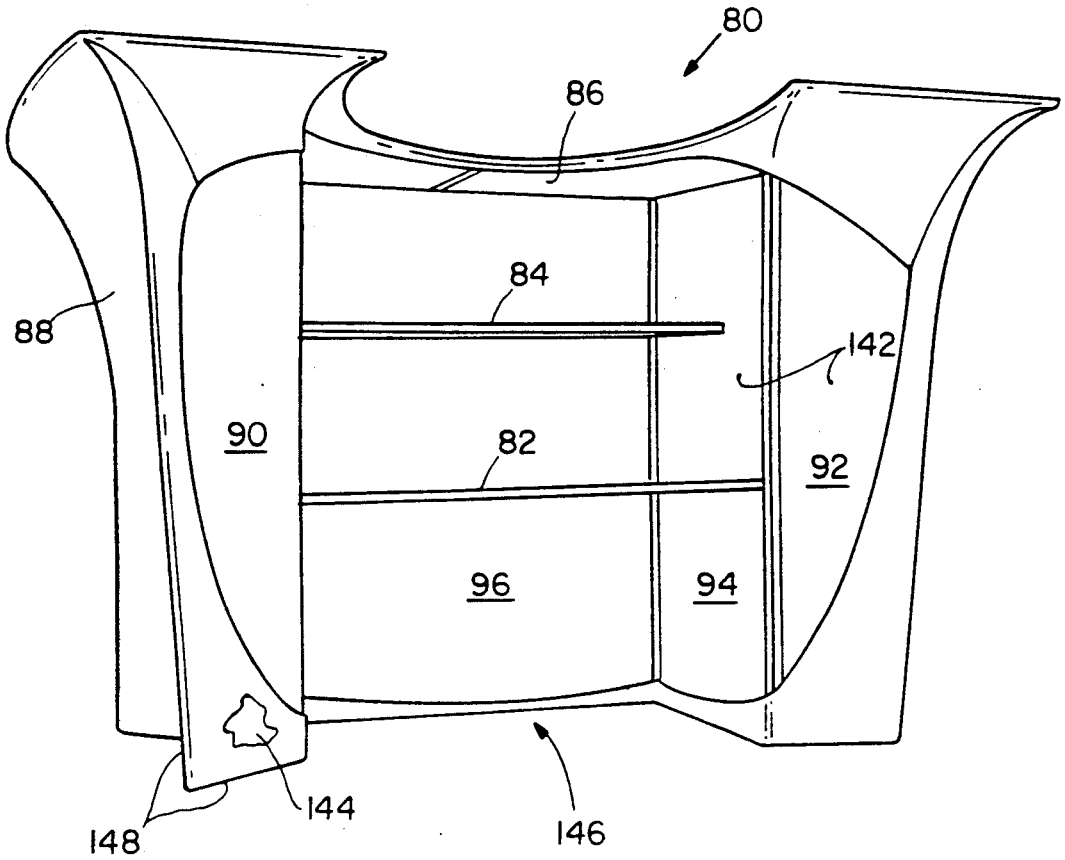
FIG. 6 is an axonometric view of a fully assembled display table according to this invention.

FIG. 6 discloses fully assembled display table 80. Display table 80 includes five vertical support members. Four of these members, 90, 92, 94 and 96 are shown. The vertical support members engage top member 86 to from frame 142. Shelf members 82 and 84 are supported in the frame interior region. The stretch fabric means 88 is fastened to top member 86 by engagement members, not shown. Exterior surface 144 of frame 142 is then covered by fabric 88, FIG. 6, 88 which stretches over and around the top member and the vertical support members and extends into frame interior region 146. Seams 148 sewn into the stretch fabric enable the fabric to fold around and grip the lower ends of the vertical support members.

When assembled in this manner, display table 80 exhibits strength and rigidity due to the interconnection between the vertical support members, the provisional connection of the shelf members to the vertical support members, and the structural tension added by the stretch fabric. The fabric is in tension and the support members are compressed. Shelves 82 and 84 and top member 86 act as bracing members for the vertical support members. Stretch fabric 88 pulls top member 86 down onto the vertical support members and pushes the vertical support members together to provide added rigidity and stability to the assembled table. In addition, this stretch fabric gives the assembled display table a curvilinear, sculptured form and provides a means for adding color to the table structure. Because the stretch fabric can be quickly changed, it allows one table structure to serve as a multi-purpose display table.

Figure 7A:
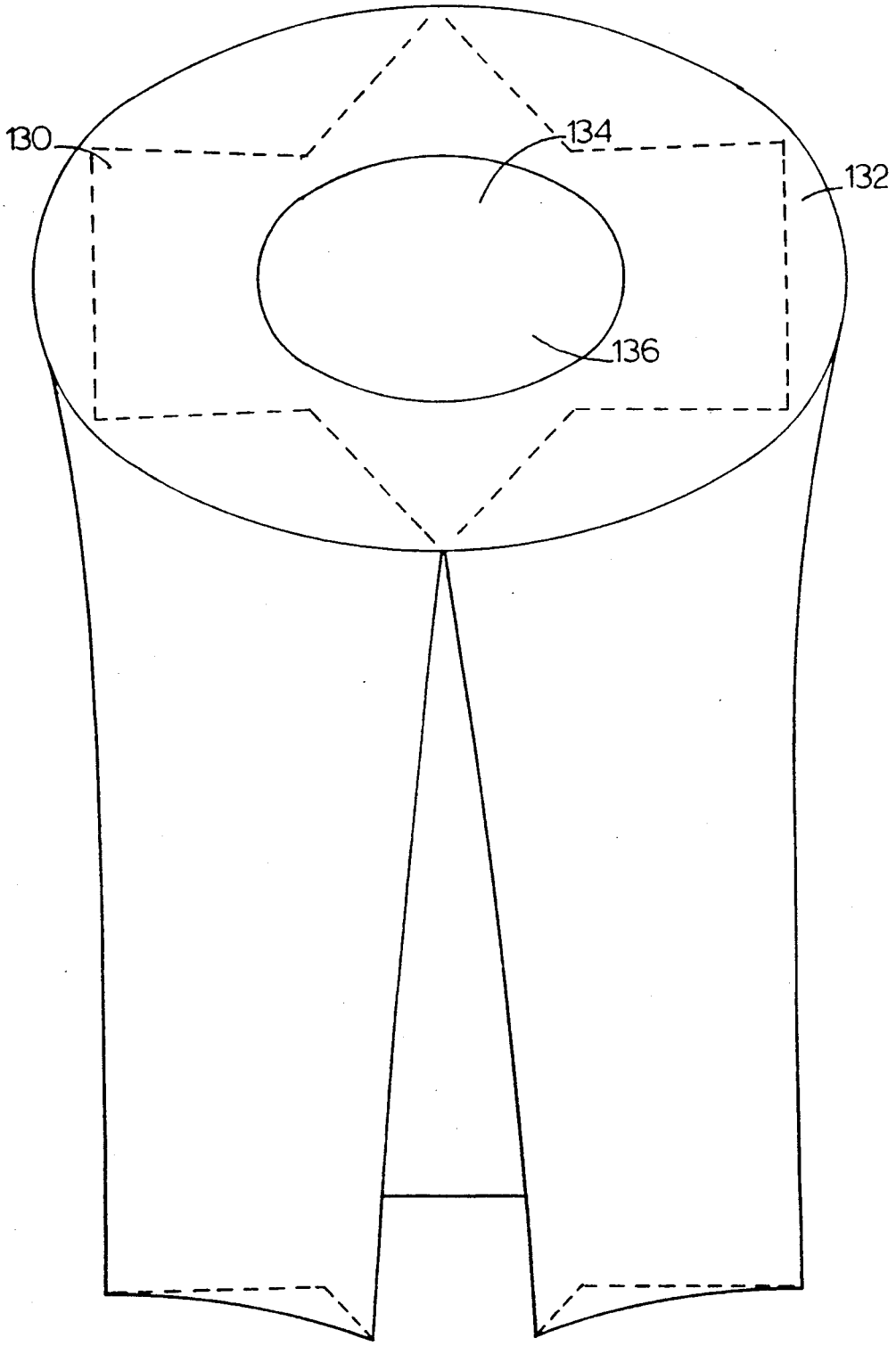
FIG. 7A is an axonometric view of one way of nesting fully assembled display tables according to this invention.
Figure 7B:
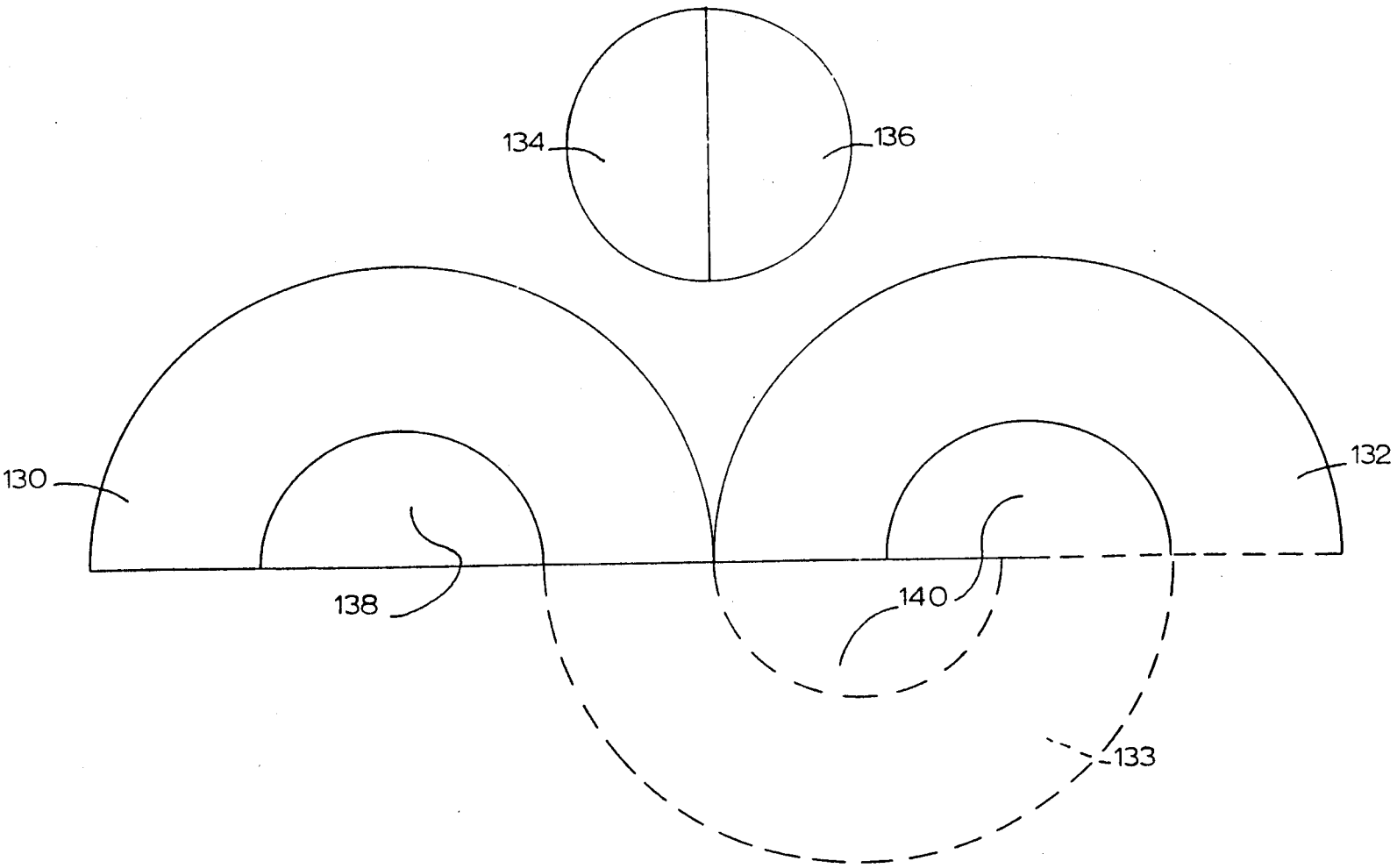
FIG. 7B is a top plan view of an alternative way of nesting and arranging the display tables of FIG. 7A.

FIGS. 7A and 7B disclose fully assembled display tables nested and set up for display use. Semi-annular display tables 130 and 132 can be placed to enclose semi-circular display tables 134 and 136 as shown in FIG. 7A. When nested in this fashion, display tables 130, 132, 134 and 136 form a single large display table nest 142. This nest can be used, for example, to display products and/or product literature.

When set up as disclosed in FIG. 7B, display tables 130 and 132 allow room for a person to stand at positions 138 and 140, respectively. Nested tables 134 and 136 can then be used to display, for example, a product. Salespeople can be positioned at tables 130 and 132 to disseminate product literature and/or information.

An alternative method of combining the units is shown by display table 133, FIG. 7B, in dashed line. This nesting set-up provides one long "S" shaped display table including tables 130 and 132. More similar display tables, not shown, may be added to the combination to create table nests of many shapes and sizes.

As is evident, display tables such as tables 130, 132, 134 and 136 can be set up in a variety of ways to accomplish varied display and promotional tasks at trade shows and conventions. The nested and separate display tables can thus be utilized for their size, shape, beauty and strength to attractively and efficiently display both large and small items.

Figure 8:
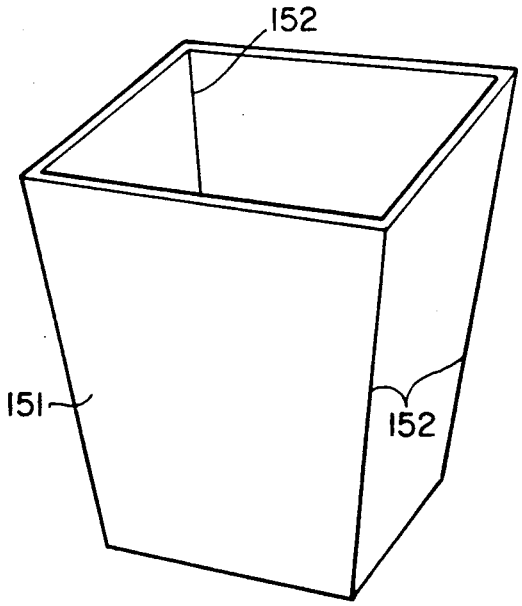
FIG. 8 is an axonometric view of another way of making the vertical support members.

Finally, display table base 150, FIG. 8, is a closed-shaped base which is preferably a trapezohedron as shown. This table may include four trapezoidal members such as member 151, hingedly connected. Alternatively, the four members may be made from a single piece of cardboard or plastic which includes scored or creased means 152 forming hinge-like areas 162. One or more engagement members, not shown, may be included to hold the table base in a closed shape when it is erected.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A display table comprising:

a frame including:

a plurality of substantially rigid vertical support members each having upper and lower ends;

means for interconnecting said vertical support members to hold said members in substantially vertical positions;

a horizontal top member; and means for connecting said top member in a substantially horizontal position to said vertical support members at said upper ends thereof to establish an exterior surface and an interior region for said frame; and a stretch fabric membrane, in frictional contact with said frame members, generally covering the frame external surface, being in tension, and extending into the frame interior region, for compressing said frame and rigidifying the table.

2. The display table of claim 1 further including at least one horizontal shelf member, each said shelf member hingedly connected to one of said vertical support members.

3. The display table of claim 2 further including means for connecting each of said shelf members to at least one of said vertical support members to support said shelf member and rigidify said vertical members.

4. The display table of claim 3 in which said means for connecting each of said shelf members includes at least one engagement member fastened to said vertical support member and a complementary engagement member fastened to said shelf member positioned to engage and lock with each other

5. The display table of claim 1 in which said means for connecting said top member to said vertical support members includes a plurality of engagement members fastened to said top member and complementary engagement members fastened to said vertical support members positioned to engage and lock with each other.

6. The display table of claim 1 in which said stretch fabric membrane is mounted to said frame with a plurality of engagement members fastened to said stretch fabric membrane and complementary engagement members fastened to said top member positioned to engage and lock with each other.

7. The display table of claim 1 in which said top member includes at least two substantially identical top member pieces hingedly connected at adjacent ends thereof.

8. The display table of claim 1 in which said means for interconnecting said vertical support members includes hinge means.

9. The display table of claim 8 in which said hinge means includes a compressed area of said vertical support member.

10. The display table of claim 9 in which said vertical support members are made from a single member with at least one compressed area for hingedly interconnecting said vertical support members.

11. The display table of claim 1 in which said means for interconnecting said vertical support members holds said members in a closed shape 12. The display table of claim 11 in which said vertical support members are trapezoidal.

13. The display table of claim 11 in which said closed shape is a trapezohedron.

14. A fabric-covered display table comprising:

a frame including:

a plurality of substantially rigid vertical support members each having upper and lower ends;

means, including hinge means, for interconnecting said vertical support members to hold said members in substantially vertical positions;

a horizontal top member having an upper and a lower surface; and means, including a plurality of engagement members fastened to said top member and complementary engagement members fastened to said vertical support members positioned to engage and lock with each other, for connecting said top member to said vertical support members at said upper ends thereof to establish an exterior surface and an interior region for said frame; and a stretch fabric membrane, in frictional contact with said frame members, generally covering the frame external surface, being in tension, and extending into the frame interior region, with a plurality of engagement members fastened to said stretch fabric membrane and complementary engagement members fastened to the lower surface of said top member positioned to engage and lock with each other, for connecting said stretch fabric membrane to said top member and to allow said stretch fabric membrane to cover said top member, said stretch fabric membrane compressing said frame and rigidifying the table.

15. The display table of claim 14 further including at least one horizontal shelf member, each said shelf member hingedly connected to one of said vertical support members; and means, including one or more engagement members fastened to said vertical support members and complementary engagement members fastened to said shelf members positioned to engage and lock with each other, for connecting each of said shelf members to one or more of said vertical support members to support said shelf member and rigidify said vertical support members.

16. A fabric-covered table comprising:

a frame including:

at least one substantially rigid vertical support member having upper and lower ends;

means, including crease means, to hold said member in a substantially vertical position;

a horizontal top member having an upper and a lower surface; and means for connecting said top member in a substantially horizontal position to said vertical support member at said upper end thereof to establish an exterior surface and an interior region for said frame; and a stretch fabric membrane, in frictional contact with said frame members, generally covering the frame external surface, being in tension, and extending into the frame interior region, for compressing said frame and rigidifying the table.

* * * * *